US005271456A

United States Patent [19]

Baumann

[11] Patent Number: 5,271,456

[45] Date of Patent: Dec. 21, 1993

[54] DRYING CYLINDERS IN PLANT FOR MANUFACTURING CARDBOARD, PAPER

[76] Inventor: Felix Baumann, 319, route Vannes, 44800 Saint-Herblain, France

[21] Appl. No.: 777,212

[22] PCT Filed: May 21, 1990

[86] PCT No.: PCT/FR90/00355

§ 371 Date: Nov. 6, 1991

§ 102(e) Date: Nov. 6, 1991

[87] PCT Pub. No.: WO90/14468

PCT Pub. Date: Nov. 29, 1990

[30] Foreign Application Priority Data

May 22, 1989 [FR] France ..... 89 06824
Nov. 21, 1989 [FR] France ..... 89 15587

[51] Int. Cl.[5] ..... F28D 11/02
[52] U.S. Cl. ..... 165/90; 34/124
[58] Field of Search ..... 34/124, 119, 110; 165/90, 91

[56] References Cited

U.S. PATENT DOCUMENTS 1,575,249 12/1923 Berry et al. .
3,449,839 7/1966 Crist .
3,612,171 10/1971 Trautner ..... 165/90
3,675,337 7/1972 Daane ..... 165/90 X
4,252,184 2/1981 Appel ..... 034/124 X

FOREIGN PATENT DOCUMENTS 3143347 5/1983 Fed. Rep. of Germany .

*Primary Examiner*—Henry A. Bennet
*Attorney, Agent, or Firm*—Sandler Greenblum & Bernstein

[57] ABSTRACT

Device for extracting condensates, inside the internal cavity of a cylinder, including a partition disposed in front of an end of the internal cavity. An orifice is positioned between the internal cylindrical wall and the periphery of the partition enabling condensates to pass and to be atomized behind the partition where they are evacuated at the shaft of the cylinder. The cross-section of the opening, between the partition and the cylinder, is a function of the diameter of the cylinder. In cylinders of large diameter, the peripheral rim of the partition may be composed of serrations which, at the same time, also serve to center the partition in the cylinder.

20 Claims, 1 Drawing Sheet

DRYING CYLINDERS IN PLANT FOR MANUFACTURING CARDBOARD, PAPER

BACKGROUND OF THE INVENTION

1. Field of the Invention

The present invention relates to improvements to drying cylinders of the type that ar especially encountered in plants for manufacturing cardboard, paper or the like.

2. Discussion of Background Information

Drying cylinders are heated by pressurized steam introduced into their internal cavity. The present invention relates more particularly to the removal of the condensates which form inside these drying cylinders.

The presence of condensates in the cylinder impairs the heat transfer between the steam and the cylindrical casing whose external wall is in contact with the paper or cardboard, whereby the effectiveness of the drying is reduced. Moreover, when the cylinder is stopped, the presence of condensates inside causes localized deformations of the casing due especially to temperature gradients. On restarting the cylinders, these deformations alter the quality of the drying, in a cyclic manner which can, in the manufacture of cardboard, for example, cause internal pasting defects.

Means for recovery of the condensates inside the cylinders do exist. A device described in U.S. Pat. No. 3,449,839 proposes two modes of recovery. A first mode consists in recovering the condensates by means of a fixed scoop maintained at a distance from the internal wall of the cylindrical casing. This device has the disadvantage of being fragile and often not very effective by reason of the difficulty in maintaining a precise clearance between the scoop and the cylindrical casing. A second system consists of suction recovery from a fixed point of the casing of the cylinder. This system has the disadvantage, when the cylinder stops rotating, of leaving the condensates in the cylinder. The suction head is randomly located within the space and becomes totally ineffective if its stop position does not correspond with the bottom point.

Other recovery devices are described especially U.S. Pat. No. 1,575,249 and DE-A-3,143,347. In these two documents, the condensates are recovered by means of orifices pierced into the ends of the cylinder, which orifices are in communication, via channels, with the shaft of the cylinder whereby the condensates escape.

These devices comprise only a limited number of orifices for evacuating the condensates. When the cylinder stops, the condensates can stagnate in the bottom if an evacuating orifice is not located at the bottommost point.

Moreover, these arrangements and, in particular, the orifices pierced in the ends, weaken these ends and the cylinders.

SUMMARY OF THE INVENTION

The present invention enables all these disadvantages to be overcome. The system for extracting condensates according to the invention makes it especially possible to be freed from the problems connected with the stopping of the cylinders in a random position; it enables condensates to be extracted in any position of the cylinder when it is stationary. The extraction system according to the invention enables condensates to be extracted continuously and permanently, whether the cylinders are moving or not. It also enables condensates to be extracted for all rotational speeds of the cylinder.

Another advantage of the extraction system according to the invention resides in the fact that it makes it possible to extract the condensates in cylinders comprising a corrugated internal wall, whether these corrugations are obtained by machining or by addition of surface-disrupting bars.

A further advantage of the system for extracting the condensates, according to the invention, resides in the fact that it imposes no maintenance constraint during the entire life of the equipment.

The device for extracting steam condensates in the drying cylinders according to the invention is constituted by at least one disk-shaped partition, through which passes the duct which enables steam to be introduced into the internal cavity of the cylinder, which partition is disposed, in front of one of the corresponding ends of the cylinder, in the cavity and comprises, on its periphery, means enabling the condensates to escape toward the shaft of the cylinder.

According to a preferred aspect of the invention, these means for the escape of the condensates include a continuous or quasi-continuous opening arranged and maintained between the periphery of the partition and the internal wall of the cylindrical casing of the cylinder, the cross-section of this opening being a function of the diameter of the cylinder.

In cylinders with a relatively small diameter, the escape opening has an annular shape. In cylinders with a larger diameter, the escape opening is in the shape of serrations made in the periphery of the partition.

Still according to the invention, the zone for the escape of the condensates, behind the partition, has a frustoconical shape, so as to form a chamber for expansion and atomization of the condensates, which escape more readily, at the shaft of the cylinder, via the corresponding end half-shaft.

According to a further aspect of the invention, the partition is housed, at the extremity of the cylinder, in a bore made in the internal cylindrical wall; the diameter of the solid portion of the partition substantially corresponds to the internal diameter of the cylinder.

BRIEF DESCRIPTION OF THE DRAWINGS

The invention will be further illustrated with the aid of the following description of an embodiment, and of the attached drawings, which are given by way of example and in which.

DETAILED DESCRIPTION OF THE PREFERRED EMBODIMENTS

Figure 1:
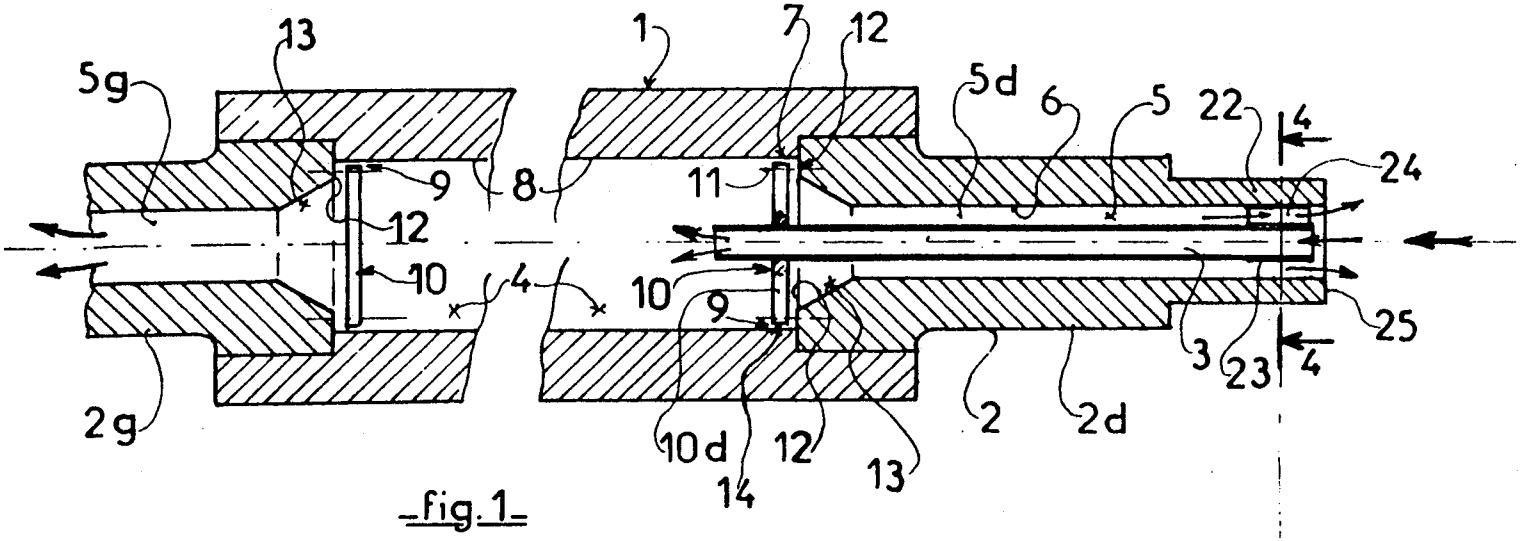
FIG. 1 shows a drying cylinder according to the invention, in longitudinal cross section.

The cylinder shown in FIG. 1 comprises a cylindrical casing 1 which may extend over a length of 1.5 to 9 meters, and more, depending on the plant. The diameter of this cylindrical casing may reach 2 meters in a very large-scale plant.

At each of the extremities of the casing 1 is provided support shaft or half-shaft 2 fixed by any appropriate means onto this casing. The half-shaft 2*d* in FIG. 1 is hollow and is traversed by a tube 3 which conveys the pressurized steam in order to bring it into the internal cavity 4 of the cylinder. There is observed, between the tube 3 and the internal cylindrical wall of the half-shaft 2*d*, a space or duct 5 which enables the internal cavity 4 of the cylinder to communicate with the outside of this cylinder, where the mixture of the condensates and steam which originates from the internal cavity is recovered.

The condensates which form inside the cavity 4 escape at the extremity 7 of the casing of the internal cylindrical wall 8 of the cylinder, via an opening 9 in the form of an annular orifice; this opening 9 is located between the internal wall 8 of the cylindrical casing of the cylinder and a disk-shaped end partition 10. This partition 10 is fixed, by appropriate means of the screw 11, onto the end 12 of the cylinder, on the end of the half-shaft 2*d*. The partition is held away from the end 12, at the internal extremity of the half-shaft 2*d*, in order to enable the condensates to pass, by means detailed hereinbelow.

The condensates escape via the central duct 5 of the half-shaft 2*d*, under the pressure of the steam prevailing in the cavity 4, The partition 10 forms a shutter or a double partition. Preferably, a partition 10 is disposed at each extremity of the cavity 4 of the cylinder. In the example of FIG. 1, its diameter is substantially less than the diameter of the internal cylindrical wall 8; the difference in diameters is of the order of 3 mm; it may depend on the size of the cylinders.

The pressurized-steam inlet tube 3 passes through the partition 10*d* in order to bring this steam into the internal cavity 4 of the cylinder and is fixed in a sealed manner to this partition 10 by any appropriate means. Between this partition 10 and the outside, are provided first of all a frustoconical chamber 13 and then the duct 5 for the escape of the condensates. The chamber 13 is in fact a chamber for expansion and atomization of the condensates. This atomization is obtained by means of a reduced space between the peripheral rim 14 of the partition 10 and the internal wall 8 of the cylinder.

Figure 2:
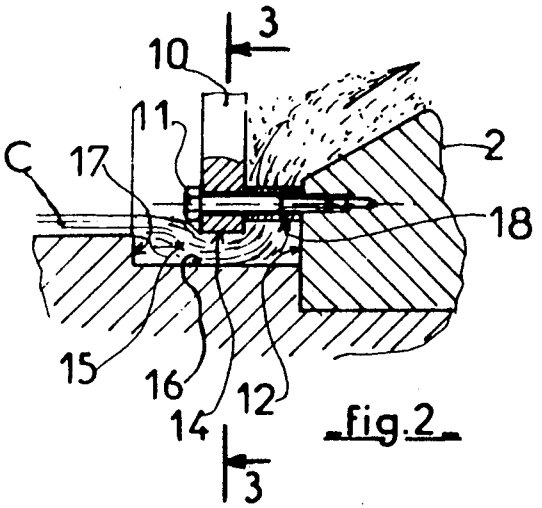
FIG. 2 shows a detail of this drying cylinder and, in particular, the detail of the orifice for passage of the condensates at the internal extremity of the cylinder, according to a preferred embodiment for cylinders of small diameter.

FIG. 2 shows, on a larger scale, a preferred arrangement of the opening 9, for the escape of the condensates, in the form of an annular orifice, between the peripheral rim 14 of the partition 10 and the internal cylindrical casing 8 of the cylinder. The internal cylindrical wall 8 comprises, at its extremity, facing the peripheral rim 14 of the partition 10, a bore forming a cylindrical cavity 15 of greater diameter than that of the partition 10 and of the internal wall 8. This bore forms a cylindrical wall 16 delimited, at the extremity of the casing 8, by an annular surface 17 and by the end 12 at the extremity of the half-shaft 2*d*. It is observed, in FIG. 2, that the partition 10 is positioned substantially equidistant from the surfaces 17 and 18. The partition 10 is housed in this cylindrical cavity 15 formed by the bore 16, preferably at each extremity of the cylinder.

The diameter of the partition 10 corresponds substantially, FIG. 2, to the diameter of the cylindrical internal wall 8. The space between the peripheral rim 14 of the partition 10 and the cylindrical wall 16 is of the order of 1.5 mm.

This space constitutes the opening 9 for the escape of the condensates. It has, as shown in FIG. 2 , the shape of an annular orifice. The cross-section of the opening 9 for the escape of the condensates is arranged as a function of the diameter of the cylinder. Thus, the escape opening 9 in the shape of an annular orifice, shown in FIG. 2, is suitable for cylinders of relatively small diameter of the order of 200 mm; for greater diameters, the opening 9 is reduced by means described hereinbelow in relation especially with FIGS. 3 and 4.

It is also observed, FIG. 2, that the partition is centered between the surfaces 17 and 12 and that the space between these walls 17 and 12 is of the order of three to four times the thickness of the partition 10.

Thus, there is provided, at the extremity 7 of the cylinder, a kind of baffle for the condensates C. These condensates cover the entire internal cylindrical wall 8 when the drying drums are in operation. These condensates tend to escape into the cylindrical cavity 15 and, from this cavity, they are propelled by the pressurized steam which fills the cavity 4 out of this cavity, by first of all passing between the peripheral rim 14 of the partition 10 and the cylindrical wall 16, then via the frustoconical chamber 13 and finally the cavity 5 of the half-shaft 2*d*, before being collected at the extremity of the latter by means not shown. As the condensates pass between the partition 10 and the wall 16, atomization transforms these condensates into a fog, which fog escapes more readily toward the center of the bearing 2 via the duct 5; it is in fact approximately constituted by 98% of steam and about 2% of water transformed into fine droplets.

There is further observed, FIG. 2, the fixing of the partition 10 onto the bearing 2 by means of screws 11, for example three in number, with interposition of a spacer 18 which ensures a precise positioning of the partition 10 with respect to the bearing 2, and, in particular, with respect to the annular face of the end 12. The partition 10 may be centered in the bore 16 by means of protuberances, not shown, for example three in number, attached onto its periphery. These protuberances may be produced by machined spot welds.

It is observed, in FIG. 1, that a partition 10 may be disposed at each of the extremities of the internal cavity 4 of the cylinder. A single steam inlet may be provided, by means of the central tube 3 and two escapes be provided for the condensate, via the central cavity 5*d* or 5*g* of the half-shafts 2*d* or 2*g*.

Figure 3:
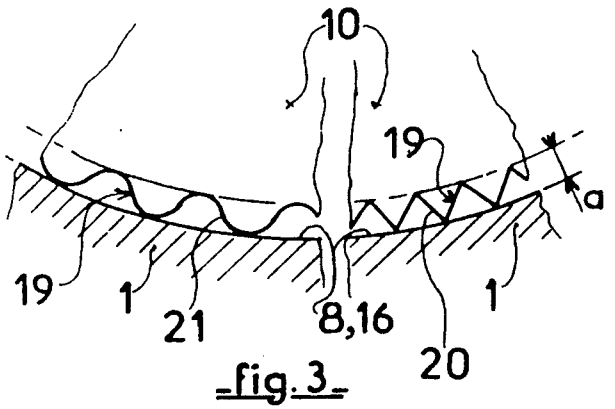
FIG. 3 is a partial cross-section along 3—3 of FIG. 2 showing two embodiments of the opening for the escape of the condensates, for cylinders of large diameter.

FIG. 3 shows the shape which the peripheral rim 14 of the partition 10 may assume. In order to reduce the cross-section of the escape opening and also in order to facilitate the centering of this partition 10 in the cylinder, the peripheral rim 14 comprises a serration 19 which may have a triangular shape 20 or a sinusoidal shape 21, such as are shown in each of the parts of the partition, FIG. 3. This arrangement at the peripheral rim of the partition 10 enables the cross-section for the escape of the condensate to be more effectively distributed and to make this cross-section correspond better to the actual requirements of the cylinders depending on their dimension especially and also depending on the quantity of steam injected.

The height a of the serrations, FIG. 3, is of the order of 1.5 mm and is preferably kept at this value regardless of the diameters of the cylinders. The variations of the cross-section of the escape opening 9 is obtained by means of the dimensions of the serrations 19.

These serrations 19 are disposed over the entire periphery of the partition 10, as well as in the embodiment of FIG. 1 than in that of FIG. 2; they offer a possibility for reducing the annular opening for the escape of the condensates, while retaining a sufficient height a. The diameter of the partition 10, taken at the end of the serrations, is substantially equal to the internal diameter of the cylinder. This escape opening 9 regulates the speed of the condensate within the serrations 19 and its transformation into fog, by atomization.

Behind the partition 10, the speed of the atomized condensates is maintained by virtue of the frustoconical chamber 13, in such a manner as to overcome the centrifugal force due to the rotation of the cylinder.

Figure 4:
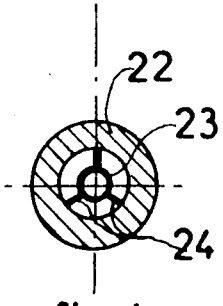
FIG. 4 is a cross-section along 4—4 of FIG. 1.

FIG. 4 shows a cross section of the extremity of the half-shaft *2d*, which extremity has the form of a journal bearing 22. The extremity of the steam inlet tube 3 is provided with a sleeve 23 which comprises, for example, three wedging fins 24 inside the duct 5. It is observed, FIG. 1, that the sleeve 23 is positioned inside the cavity 5 of the journal bearing, set back from the end face 25 in order to avoid any mishap to the tube 3 on handling and/or transporting the cylinder.

Moreover, this sleeve is threaded with a right-hand or left-hand thread depending on the direction of rotation of the cylinder, in order to produce the connection with the rotating joint of a steam box, not shown.

I claim:

1. Device for extracting steam condensates in drying cylinders of plant for manufacturing cardboard or paper, comprising:

at least one cylinder comprising a cylindrical casing, said cylindrical casing having an internal wall and an end at each extremity;

at lest one shaft in at least one of said each extremity, said at least one shaft comprising a central tube permitting the intake of steam and a duct surrounding said central tube enabling the extraction of condensates; and at least one disk-shaped partition positioned at least one of said each extremity and having a first side facing said duct and an opposite facing second side, said second side and said internal wall defining an internal cavity, said at least one partition and said central tube being constructed and arranged to permit the steam entering said central tube to enter into said internal cavity, a periphery surrounding said at least one partition, and at least one opening positioned at said periphery to permit flow of fluids from said internal cavity to said duct through said at least one opening.

2. The device according to claim 1, wherein said at least one partition includes a peripheral rim and a serration is arranged over said peripheral rim forming said at least one opening as a serrated annular orifice.

3. The device according to claim 1, wherein said at least one opening has a height of about 1.5 mm.

4. The device according to claim 2, wherein said at least one opening has a height of about 1.5 mm.

5. The device according to claim 1, comprising a frustoconical-shaped atomization chamber behind said at least one partition.

6. The device according to claim 2, comprising a frustoconical-shaped atomization chamber behind said at least one partition.

7. The device according to claim 3, comprising a frustoconical-shaped atomization chamber behind said at least one partition.

8. The device according to claim 4, comprising a frustoconical-shaped atomization chamber behind said at least one partition.

9. The device according to claim 1, wherein said at least one partition is integral with said end at each extremity.

10. The device according to claim 9, including a spacer for spacing said at least one partition from said end at each extremity.

11. The device according to claim 1, wherein said at least one partition includes an element for centering said at least one partition within said internal cavity.

12. The device according to claim 2, wherein an element is positioned on said peripheral rim for centering said at least one partition in said internal cavity.

13. The device according to claim 1, comprising a cylindrical groove which is centered with respect to said at least one partition, and having a diameter greater than said internal wall and said at least one partition.

14. The device according to claim 2, comprising a cylindrical groove which is centered with respect to said at least one partition, and having a diameter greater than said internal wall and said at least one partition.

15. The device according to claim 3, comprising a cylindrical groove which is centered with respect to said at least one partition, and having a diameter greater than said internal wall and said at least one partition.

16. The device according to claim 1, wherein said central tube is integral with said at least one partition, and a sleeve having fins in positioned within said duct.

17. The device according to claim 2, wherein said central tube is integral with said at least one partition, and a sleeve having fins is positioned within said duct.

18. The device according to claim 3, wherein said central tube is integral with said at least one partition, and a sleeve having fins is positioned within said duct.

19. The device according to claim 1, wherein said at least one shaft comprises at least one half-shaft.

20. The device according to claim 2, wherein said at least one shaft comprises at least one half-shaft.

* * * * *